US011158259B2

(12) United States Patent
Wang et al.

(10) Patent No.: US 11,158,259 B2
(45) Date of Patent: Oct. 26, 2021

(54) ACTIVE SENSING AND COMPENSATION FOR DISPLAY PANEL HYSTERESIS

(71) Applicant: Apple Inc., Cupertino, CA (US)

(72) Inventors: Chaohao Wang, Sunnyvale, CA (US); Chih-Wei Yeh, Campbell, CA (US); Chin-Wei Lin, San Jose, CA (US); Hung Sheng Lin, San Jose, CA (US); Hyunwoo Nho, Palo Alto, CA (US); Injae Hwang, Cupertino, CA (US); Jie Won Ryu, Santa Clara, CA (US); Junhua Tan, Saratoga, CA (US); Paolo Sacchetto, Cupertino, CA (US); Rui Zhang, Sunnyvale, CA (US); Shengkui Gao, San Jose, CA (US); Sun-Il Chang, San Jose, CA (US); Wei H. Yao, Palo Alto, CA (US); Howard H. Tang, San Diego, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 17/088,263

(22) Filed: Nov. 3, 2020

(65) Prior Publication Data

US 2021/0049962 A1 Feb. 18, 2021

Related U.S. Application Data

(62) Division of application No. 15/701,056, filed on Sep. 11, 2017, now Pat. No. 10,825,385.

(60) Provisional application No. 62/397,835, filed on Sep. 21, 2016.

(51) Int. Cl.
*G09G 3/3233* (2016.01)
*G09G 3/3275* (2016.01)

(52) U.S. Cl.
CPC ..... *G09G 3/3233* (2013.01); *G09G 3/3275* (2013.01); *G09G 2300/0861* (2013.01); *G09G 2310/0262* (2013.01); *G09G 2320/0233* (2013.01); *G09G 2320/0257* (2013.01); *G09G 2320/0295* (2013.01); *G09G 2320/043* (2013.01); *G09G 2320/0693* (2013.01); *G09G 2330/02* (2013.01); *G09G 2330/12* (2013.01); *G09G 2340/16* (2013.01); *G09G 2360/18* (2013.01)

(58) Field of Classification Search
None
See application file for complete search history.

(56) References Cited

U.S. PATENT DOCUMENTS

2005/0116902 A1 6/2005 Miyzawa
2011/0205250 A1 8/2011 Yoo et al.
2015/0015557 A1 1/2015 Kim

*Primary Examiner* — Aneeta Yodichkas
(74) *Attorney, Agent, or Firm* — Fletcher Yoder, P.C.

(57) ABSTRACT

An apparatus receives current image frame data and data relating to at least one previous image frame for an electronic display. One or more parameters related to hysteresis of transistors in the electronic display are sensed. A correlation device, such as a look-up table, receives the sensed parameter or parameters and the data relating to one or more image frames, and uses this information, at least in part, to output an appropriate compensation signal for the current image frame data. The compensated current image frame data may then be supplied to the electronic display to reduce or eliminate the effects of hysteresis on the displayed image.

21 Claims, 18 Drawing Sheets

1. SENSING AT BEGINNING OF FRAME (FOR TRANSIENT PEAK)
2. SENSING IN THE MIDDLE OF FRAME (FOR OPTIMIZATION)
3. SENSING THROUGHOUT THE FRAME (FOR AVERAGE LUMINANCE)

4. MULTIPLE SENSE PER FRAME TO CAPTURE TIME CONSTANT

ACTIVE SENSING AND COMPENSATION FOR DISPLAY PANEL HYSTERESIS

CROSS-REFERENCE TO RELATED APPLICATION

This is a divisional application of U.S. patent application Ser. No. 15/701,056, filed Sep. 11, 2017, entitled "Active Sensing and Compensation for Display Panel Hysteresis," which claims priority to U.S. Provisional Application No. 62/397,835, filed Sep. 21, 2016, entitled "Active Sensing and Compensation for Display Panel Hysteresis," the contents of which are incorporated by reference in its entirety for all purposes.

BACKGROUND

The present disclosure relates generally to electronic displays and, more particularly, to techniques to compensate for certain anomalies, such as hysteresis, in electronic displays.

This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

Many electronic devices include an electronic display that displays visual representations based on received image data. More specifically, the image data may include a voltage that indicates desired luminance (e.g., brightness) of a display pixel. For example, in an organic light emitting diode (OLED) display, the image data may be input to and amplified by one or more amplifiers. The amplified image data may then be supplied the gate of a switching device (e.g., a thin film transistor) in a display pixel. Based on magnitude of the supplied voltage, the switching device may control magnitude of supply current flowing into a light emitting component (e.g., OLED) of the display pixel.

The display pixel may then emit light based on magnitude of the supply current flowing through the light emitting component. For example, as magnitude of the supply current increases, the luminance (e.g., brightness and/or grayscale value) of the display pixel may increase. On the other hand, as magnitude of the supply current decreases, the luminance of the display pixel may decrease. In other words, any change in magnitude of the supply current may cause a change in luminance of a display pixel.

For example, in active matrix organic light emitting diode (AMOLED) displays, a matrix of thin film transistors (TFTs), typically formed on an amorphous or polycrystalline polysubstrate, are used to supply the image data to the OLEDs. Such AMOLED displays have become quite popular because of their high brightness, deep black level, and wide viewing angle capabilities. Moreover, such TFTs are often advantageous because they provide high uniformity in large areas. Unfortunately, however, the TFTs exhibit some degree of hysteresis in switching between positive and negative voltages. This hysteresis can affect the threshold voltage of the transistors, and thus, the magnitude of the current being provided to the OLEDS. As a result, the luminance provided by the OLEDS may be inaccurate in that it does not match the image data being supplied to the TFTs. This phenomenon can lead to a residual image, sometimes referred to as image sticking, where the previously displayed image remains somewhat apparent in the subsequently displayed image. Moreover, the phenomenon can lead to other undesirable image artifacts such as mura artifacts, flicker, etc.

In addition to the above potential issues, various environmental conditions can also adversely affect the image quality of an AMOLED display. For example, changes in temperature, humidity, and even ambient light, can lead to changes in the threshold voltage of the TFTs and, thus, adversely affect the luminance of the OLEDs.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

The present disclosure generally relates to electronic displays that display image frames to facilitate visually presenting information. Generally an electronic display displays an image frame by controlling luminance of its display pixels based at least in part on image data indicating desired luminance of the display pixels. For example, to facilitate displaying an image frame, an organic light emitting diode (OLED) may display may receive image data, amplify the image data using one or more amplifiers, and supply amplified image data to display pixels. When activated, display pixels may apply the amplified image data to the gate of a switching device (e.g., thin-film transistor) to control magnitude of the supply current flowing through a light emitting component (e.g., OLED). In this manner, since the luminance of OLED display pixels is based on supply current flowing through their light emitting components, the image frame may be displayed based at least in part on corresponding image data.

With this background in mind, and to address some of the issues mentioned above, the present techniques provide a method of operating an electronic display to compensate a new or current frame image to reduce or eliminate the effects of hysteresis exhibited by the TFTs used to drive the pixels. The method may generally include sensing one or more parameters related to hysteresis of TFTs in the electronic display, and such parameters may include, for example, threshold voltage, supply current, temperature, etc. Information related to one or more previous image frames may be obtained. Utilizing the sensed parameter or parameters along with the previous image frame information, a new image frame may be compensated to reduce or eliminate the effects of hysteresis on the new image frame to be displayed on the electronic display.

BRIEF DESCRIPTION OF THE DRAWINGS

Various aspects of this disclosure may be better understood upon reading the following detailed description and upon reference to the drawings in which.

DETAILED DESCRIPTION OF SPECIFIC EMBODIMENTS

Figure 1:
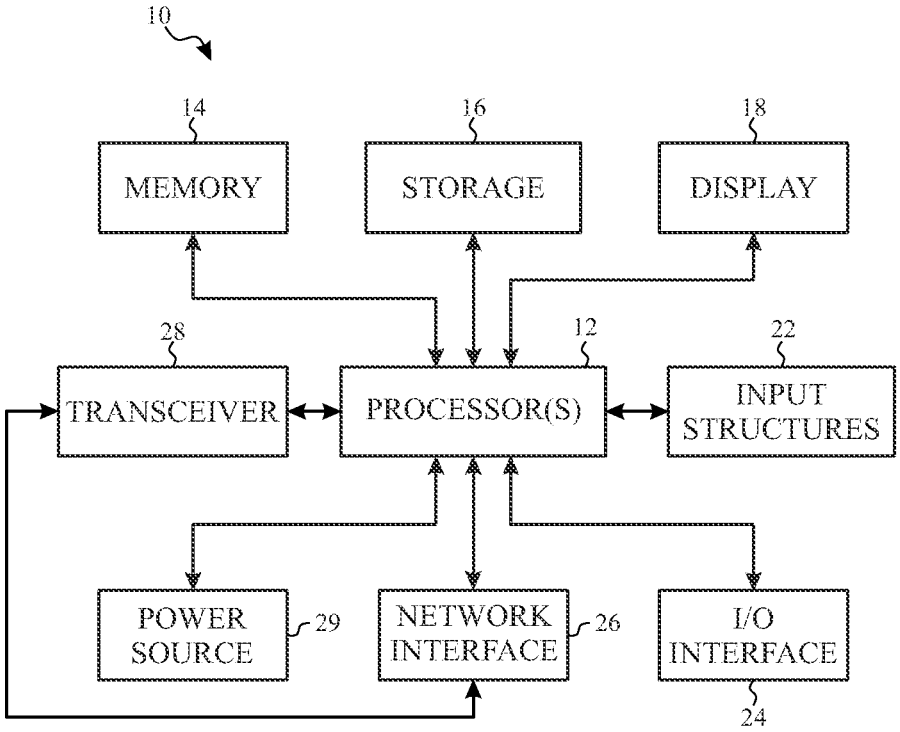
FIG. 1 is a schematic block diagram of an electronic device including an electronic display, in accordance with an embodiment.

One or more specific embodiments will be described below. In an effort to provide a concise description of these embodiments, not all features of an actual implementation are described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

As mentioned above, embodiments of the present disclosure relate to electronic displays used to display visual representations as image frames. Thus, electronic displays are often included in various electronic devices to facilitate visually presenting information to users. In fact, different electronic devices may utilize different types of electronics displays. For example, some electronic devices may utilize a liquid crystal (LCD) display while other electronic devices utilize organic light emitting diode (OLED) display, such as active matrix organic light emitting diode (AMOLED) displays and passive matrix organic light emitting diode (PMOLED) displays, and still other electronic devices may utilize micro light emitting diode (μLED) displays.

However, operation between different types of electronic displays may vary. For example, an LCD display may display an image frame by controlling luminance (e.g., brightness and/or grayscale value) of LCD display pixels based on orientation of liquid crystals. More specifically, in an LCD display pixel, a voltage based on received image data may be applied to a pixel electrode, thereby generating an electric field that orients the liquid crystals. In some embodiments, to reduce likelihood of polarizing the LCD display pixel, polarity of the voltage applied to the pixel electrode may be positive for some image frames and negative for other image frames.

On the other hand, an OLED display may display an image frame by controlling luminance (e.g., brightness and/or grayscale value) of OLED display pixels based on magnitude of supply current flowing through a light emitting component (e.g., OLED) of the display pixels. More specifically, a voltage based on received image data may be applied to the gate of a switching device (e.g., thin-film transistor) in an OLED display pixel to control magnitude of supply current flowing to its light emitting component. In some embodiments, since luminance of the OLED display pixel is controlled by magnitude of supply current, polarity of the voltage applied to the switching device may remain the same for each image frame.

Although differences exist, some operational principles of different types of electronic displays may be similar. For example, as described above, the LCD display and the OLED display may both display image frames by controlling luminance of their display pixels. Additionally, the LCD display and the OLED display may both control luminance of their display pixels based on received image data, which may indicate desired luminance of display pixels based on magnitude of its voltage. Furthermore, in some embodiments, the LCD display and the OLED display may both amplify the image data and use the amplified image data to control operation in their display pixels. In other words, although the present disclosure is described in regard to OLED displays, one of ordinary skill in the art should be able to adapt the techniques described herein to other types of suitable electronic displays.

As described above, an OLED display may display image frames by controlling luminance of its display pixels. In some embodiments, an OLED display pixel may include a self-emissive light emitting component that emits light based at least in part on magnitude of current supplied to a storage capacitor. For example, as magnitude of the supply current increases, the luminance of the display pixel may also increase. On the other hand, as magnitude of the supply current decreases, the luminance of the display pixel may also decrease.

Additionally, the OLED display may control magnitude of the supply current to the display pixel using a switching device (e.g., a thin-film transistor). In some embodiments, the OLED display may receive image data indicating desired luminance of the display pixel, amplify the image data, and apply the amplified image data to a gate of the switching device. In such embodiments, voltage of the amplified image data may control width of the switching device channel available to conduct supply current to the light emitting component. For example, as magnitude of the amplified image data increases, the magnitude of the supply current may increase. On the other hand, as magnitude of the amplified image data decreases, the magnitude of the supply current may decrease. In this manner, the OLED display may adjust luminance of the display pixels based at least in part on received image data.

However, the luminance of OLED display pixels may also be affected by other factors, such as noise introduced in the image data, the amplified image data, and/or the supply current. When drastic enough, the luminance variations caused by introduced noise may be perceivable as visual artifacts or muras. Such noise may be caused by various environmental factors, such as temperature and humidity, as well as by various operating parameters within the electronic display itself, such as the hysteresis behavior of the thin-film transistors (TFTs) in the pixel circuits and by image data from previous frames, as well as the refresh rate of the display.

To address some of these concerns, the present techniques may sense one or more parameters from the display, such as luminance, current, voltage, or other measurable pixel properties, which may be used as feedback in either real time or as triggered by device usage. Such feedback may be used in a map or look-up table to compensate for factors that may adversely affect pixel luminance, such as hysteresis, refresh rate, temperature, previous image data, etc. Indeed, as described in further detail below, such displays may be used in a variety of electronic devices, and various techniques may be used to provide compensation for such displays.

With the foregoing in mind, a general description of suitable electronic devices that may employ an electronic display will be provided below. Turning first to FIG. 1, an electronic device 10 according to an embodiment of the present disclosure may include, among other things, one or more processor(s) 12, memory 14, nonvolatile storage 16, a display 18, input structures 22, an input/output (I/O) interface 24, network interfaces 26, a transceiver 28, and a power source 29. The various functional blocks shown in FIG. 1 may include hardware elements (including circuitry), software elements (including computer code stored on a computer-readable medium) or a combination of both hardware and software elements. It should be noted that FIG. 1 is merely one example of a particular implementation and is intended to illustrate the types of components that may be present in electronic device 10.

Figure 2:
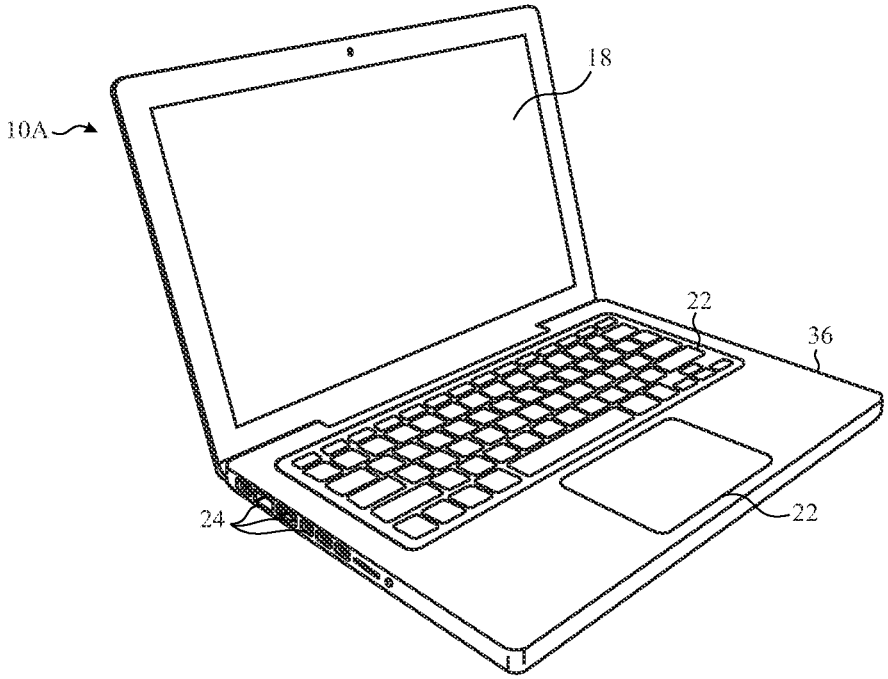
FIG. 2 is a perspective view of a notebook computer representing an embodiment of the electronic device of FIG. 1.
Figure 3:
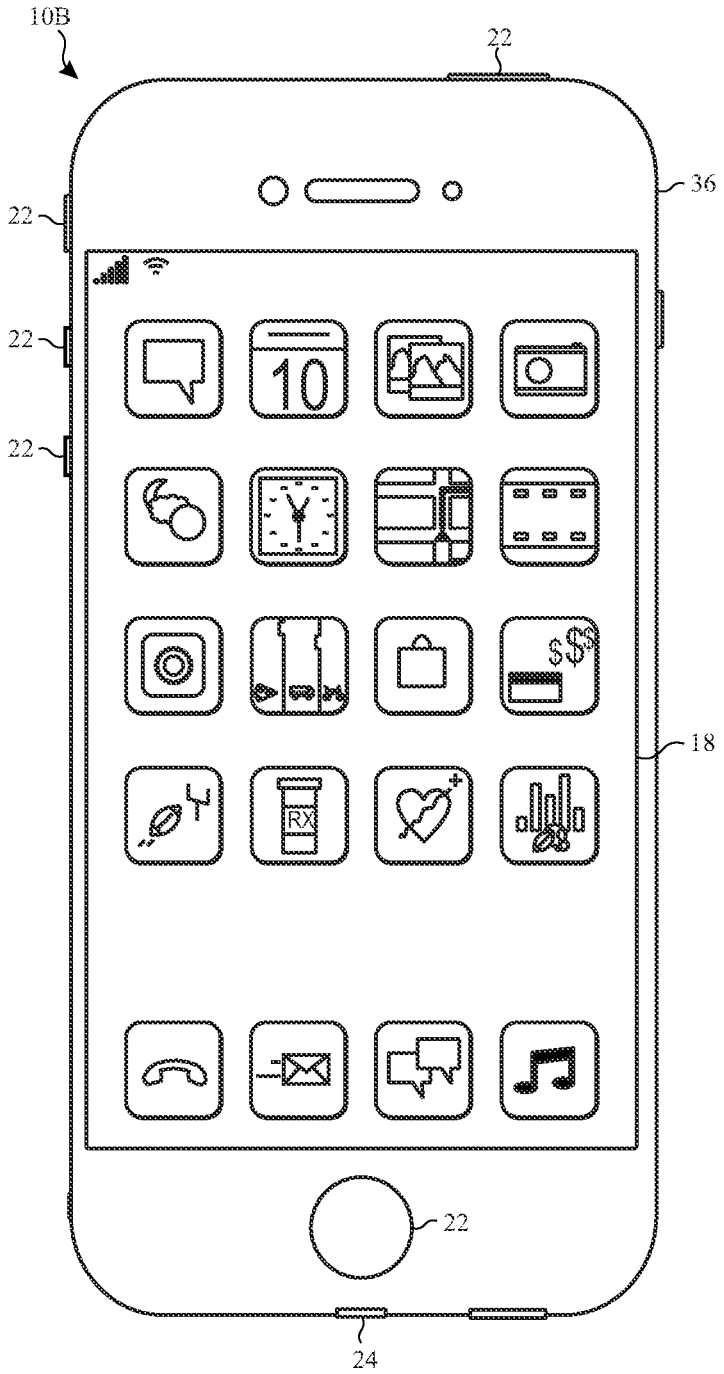
FIG. 3 is a front view of a hand-held device representing another embodiment of the electronic device of FIG. 1.
Figure 4:
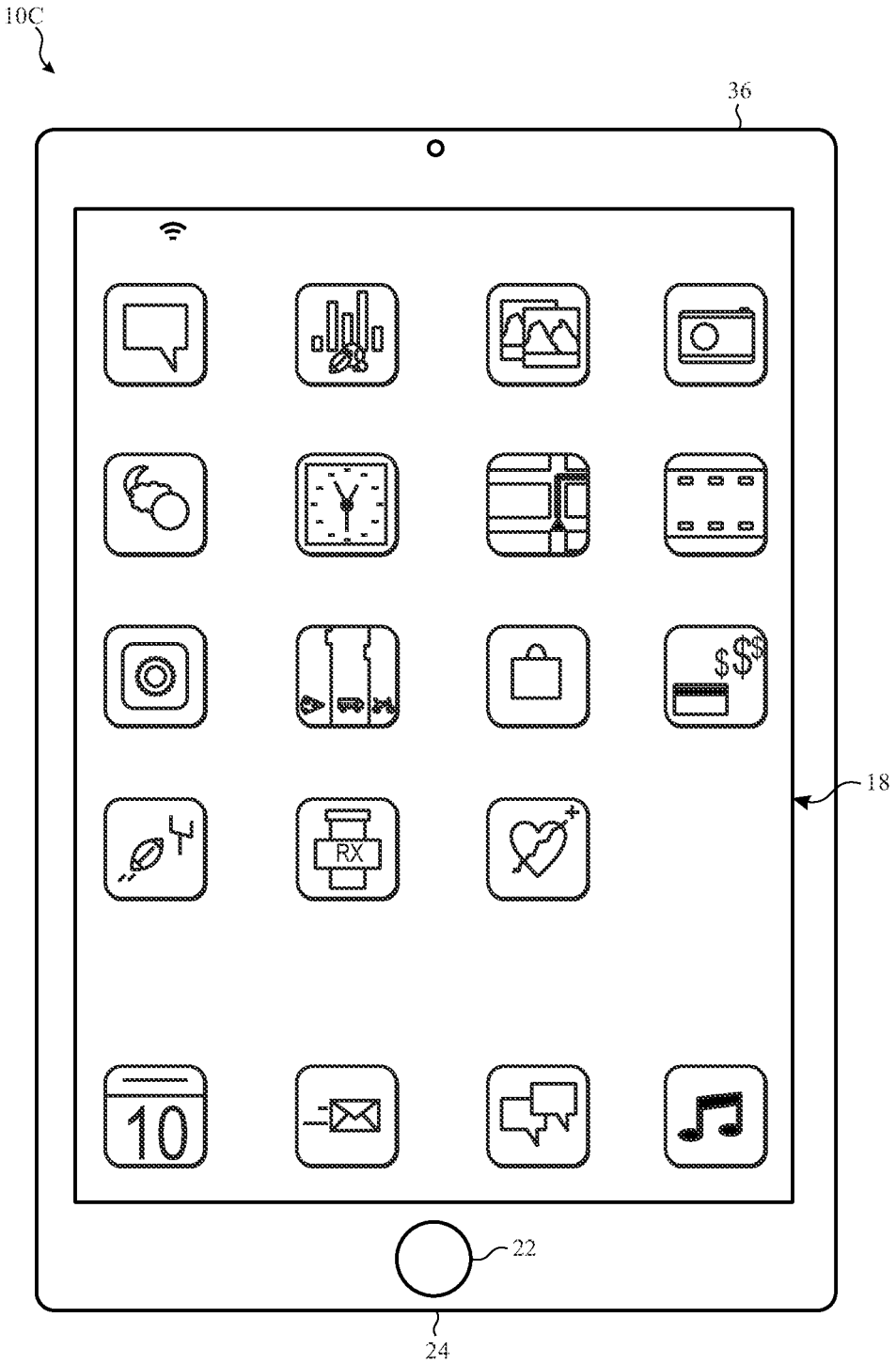
FIG. 4 is a front view of another hand-held device representing another embodiment of the electronic device of FIG. 1.
Figure 5:
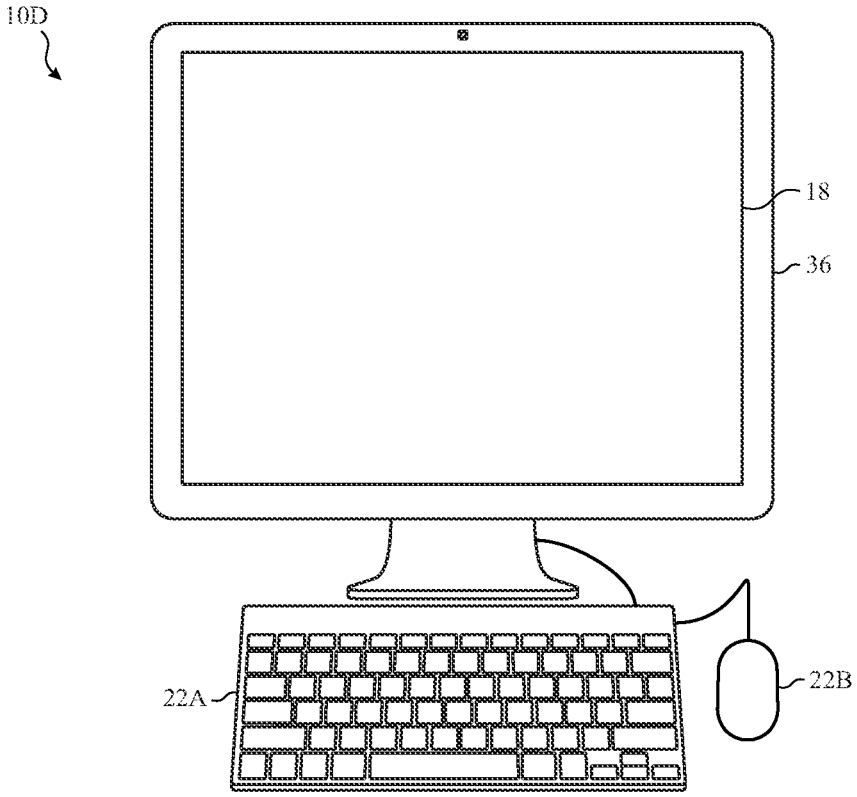
FIG. 5 is a front view of a desktop computer representing another embodiment of the electronic device of FIG. 1.
Figure 6:
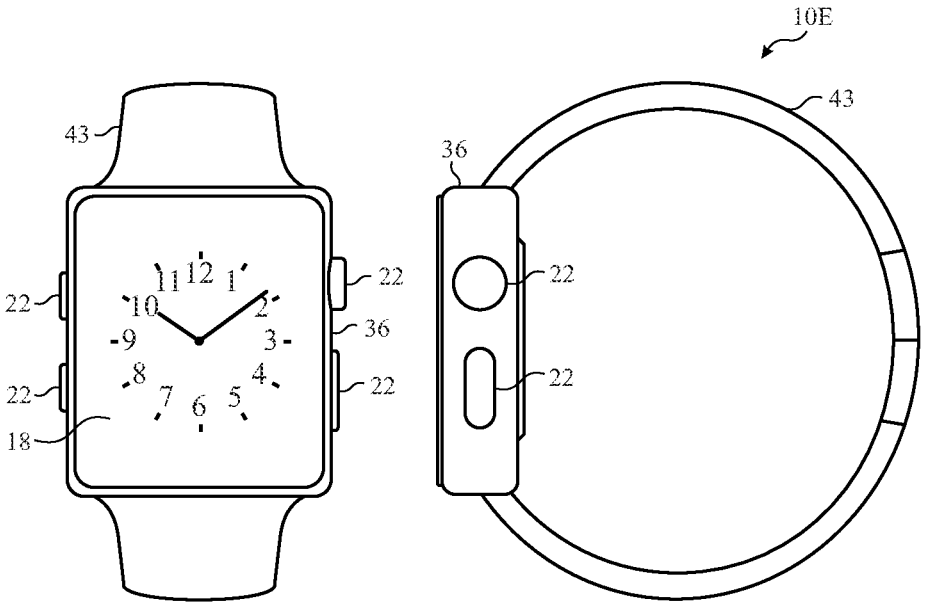
FIG. 6 is a front view and side view of a wearable electronic device representing another embodiment of the electronic device of FIG. 1.

By way of example, the electronic device 10 may represent a block diagram of the notebook computer depicted in FIG. 2, the handheld device depicted in FIG. 3, the handheld device depicted in FIG. 4, the desktop computer depicted in FIG. 5, the wearable electronic device depicted in FIG. 6, or similar devices. It should be noted that the processor(s) 12 and/or other data processing circuitry may be generally referred to herein as "data processing circuitry." Such data processing circuitry may be embodied wholly or in part as software, firmware, hardware, or any combination thereof. Furthermore, the data processing circuitry may be a single contained processing module or may be incorporated wholly or partially within any of the other elements within the electronic device 10.

In the electronic device 10 of FIG. 1, the processor(s) 12 and/or other data processing circuitry may be operably coupled with the memory 14 and the nonvolatile storage 16 to perform various algorithms. Such programs or instructions executed by the processor(s) 12 may be stored in any suitable article of manufacture that includes one or more tangible, computer-readable media at least collectively storing the instructions or routines, such as the memory 14 and the nonvolatile storage 16. The memory 14 and the nonvolatile storage 16 may include any suitable articles of manufacture for storing data and executable instructions, such as random-access memory, read-only memory, rewritable flash memory, hard drives, and optical discs. Also, programs (e.g., an operating system) encoded on such a computer program product may also include instructions that may be executed by the processor(s) 12 to enable the electronic device 10 to provide various functionalities.

In certain embodiments, the display 18 may be an active-matrix organic light emitting diode (AMOLED) display, which may allow users to view images generated on the electronic device 10. In some embodiments, the display 18 may include a touch screen, which may allow users to interact with a user interface of the electronic device 10. Furthermore, it should be appreciated that, in some embodiments, the display 18 may include one or more organic light emitting diode (OLED) displays, or some combination of LCD panels and OLED panels.

The input structures 22 of the electronic device 10 may enable a user to interact with the electronic device 10 (e.g., pressing a button to increase or decrease a volume level). The I/O interface 24 may enable electronic device 10 to interface with various other electronic devices, as may the network interfaces 26. The network interfaces 26 may include, for example, interfaces for a personal area network (PAN), such as a Bluetooth network, for a local area network (LAN) or wireless local area network (WLAN), such as an 802.11x Wi-Fi network, and/or for a wide area network (WAN), such as a $3^{rd}$ generation (3G) cellular network, $4^{th}$ generation (4G) cellular network, long term evolution (LTE) cellular network, or long term evolution license assisted access (LTE-LAA) cellular network. The network interface 26 may also include interfaces for, for example, broadband fixed wireless access networks (WiMAX), mobile broadband Wireless networks (mobile WiMAX), asynchronous digital subscriber lines (e.g., ADSL, VDSL), digital video broadcasting-terrestrial (DVB-T) and its extension DVB Handheld (DVB-H), ultra Wideband (UWB), alternating current (AC) power lines, and so forth.

In certain embodiments, to allow the electronic device 10 to communicate over the aforementioned wireless networks (e.g., Wi-Fi, WiMAX, mobile WiMAX, 4G, LTE, and so forth), the electronic device 10 may include a transceiver 28. The transceiver 28 may include any circuitry the may be useful in both wirelessly receiving and wirelessly transmitting signals (e.g., data signals). Indeed, in some embodiments, as will be further appreciated, the transceiver 28 may include a transmitter and a receiver combined into a single unit, or, in other embodiments, the transceiver 28 may include a transmitter separate from the receiver. For example, the transceiver 28 may transmit and receive OFDM signals (e.g., OFDM data symbols) to support data communication in wireless applications such as, for example, PAN networks (e.g., Bluetooth), WLAN networks (e.g., 802.11x Wi-Fi), WAN networks (e.g., 3G, 4G, and LTE and LTE-LAA cellular networks), WiMAX networks, mobile WiMAX networks, ADSL and VDSL networks, DVB-T and DVB-H networks, UWB networks, and so forth. As further illustrated, the electronic device 10 may include a power source 29. The power source 29 may include any suitable source of power, such as a rechargeable lithium polymer (Li-poly) battery and/or an alternating current (AC) power converter.

In certain embodiments, the electronic device 10 may take the form of a computer, a portable electronic device, a wearable electronic device, or other type of electronic device. Such computers may include computers that are generally portable (such as laptop, notebook, and tablet computers) as well as computers that are generally used in one place (such as conventional desktop computers, workstations and/or servers). In certain embodiments, the electronic device 10 in the form of a computer may be a model of a MacBook®, MacBook® Pro, MacBook Air®, iMac®, Mac® mini, or Mac Pro® available from Apple Inc. By way of example, the electronic device 10, taking the form of a notebook computer 10A, is illustrated in FIG. 2 in accordance with one embodiment of the present disclosure. The depicted computer 10A may include a housing or enclosure 36, a display 18, input structures 22, and ports of an I/O interface 24. In one embodiment, the input structures 22 (such as a keyboard and/or touchpad) may be used to interact with the computer 10A, such as to start, control, or operate a GUI or applications running on computer 10A. For example, a keyboard and/or touchpad may allow a user to navigate a user interface or application interface displayed on display 18.

FIG. 3 depicts a front view of a handheld device 10B, which represents one embodiment of the electronic device 10. The handheld device 10B may represent, for example, a portable phone, a media player, a personal data organizer, a handheld game platform, or any combination of such devices. By way of example, the handheld device 10B may be a model of an iPod® or iPhone® available from Apple Inc. of Cupertino, Calif. The handheld device 10B may include an enclosure 36 to protect interior components from physical damage and to shield them from electromagnetic interference. The enclosure 36 may surround the display 18. The I/O interfaces 24 may open through the enclosure 36 and may include, for example, an I/O port for a hard wired connection for charging and/or content manipulation using a standard connector and protocol, such as the Lightning connector provided by Apple Inc., a universal service bus (USB), or other similar connector and protocol.

User input structures 22, in combination with the display 18, may allow a user to control the handheld device 10B. For example, the input structures 22 may activate or deactivate the handheld device 10B, navigate user interface to a home screen, a user-configurable application screen, and/or activate a voice-recognition feature of the handheld device 10B. Other input structures 22 may provide volume control, or may toggle between vibrate and ring modes. The input structures 22 may also include a microphone may obtain a user's voice for various voice-related features, and a speaker may enable audio playback and/or certain phone capabilities. The input structures 22 may also include a headphone input may provide a connection to external speakers and/or headphones.

FIG. 4 depicts a front view of another handheld device 10C, which represents another embodiment of the electronic device 10. The handheld device 10C may represent, for example, a tablet computer, or one of various portable computing devices. By way of example, the handheld device 10C may be a tablet-sized embodiment of the electronic device 10, which may be, for example, a model of an iPad® available from Apple Inc. of Cupertino, Calif.

Turning to FIG. 5, a computer 10D may represent another embodiment of the electronic device 10 of FIG. 1. The computer 10D may be any computer, such as a desktop computer, a server, or a notebook computer, but may also be a standalone media player or video gaming machine. By way of example, the computer 10D may be an iMac®, a MacBook®, or other similar device by Apple Inc. It should be noted that the computer 10D may also represent a personal computer (PC) by another manufacturer. A similar enclosure 36 may be provided to protect and enclose internal components of the computer 10D such as the display 18. In certain embodiments, a user of the computer 10D may interact with the computer 10D using various peripheral input devices, such as the keyboard 22A or mouse 22B (e.g., input structures 22), which may connect to the computer 10D.

Similarly, FIG. 6 depicts a wearable electronic device 10E representing another embodiment of the electronic device 10 of FIG. 1 that may be configured to operate using the techniques described herein. By way of example, the wearable electronic device 10E, which may include a wristband 43, may be an Apple Watch® by Apple, Inc. However, in other embodiments, the wearable electronic device 10E may include any wearable electronic device such as, for example, a wearable exercise monitoring device (e.g., pedometer, accelerometer, heart rate monitor), or other device by another manufacturer. The display 18 of the wearable electronic device 10E may include a touch screen display 18 (e.g., LCD, OLED display, active-matrix organic light emitting diode (AMOLED) display, and so forth), as well as input structures 22, which may allow users to interact with a user interface of the wearable electronic device 10E.

As described above, the computing device 10 may include an electronic display 18 to facilitate presenting visual representations to one or more users. Accordingly, the electronic display 18 may be any one of various suitable types. For example, in some embodiments, the electronic display 18 may be an LCD display while, in other embodiments, the display may be an OLED display, such as an AMOLED display or a PMOLED display. Although operation may vary, some operational principles of different types of electronic displays 18 may be similar. For example, electronic displays 18 may generally display image frames by controlling luminance of their display pixels based on received image data.

Figure 7:
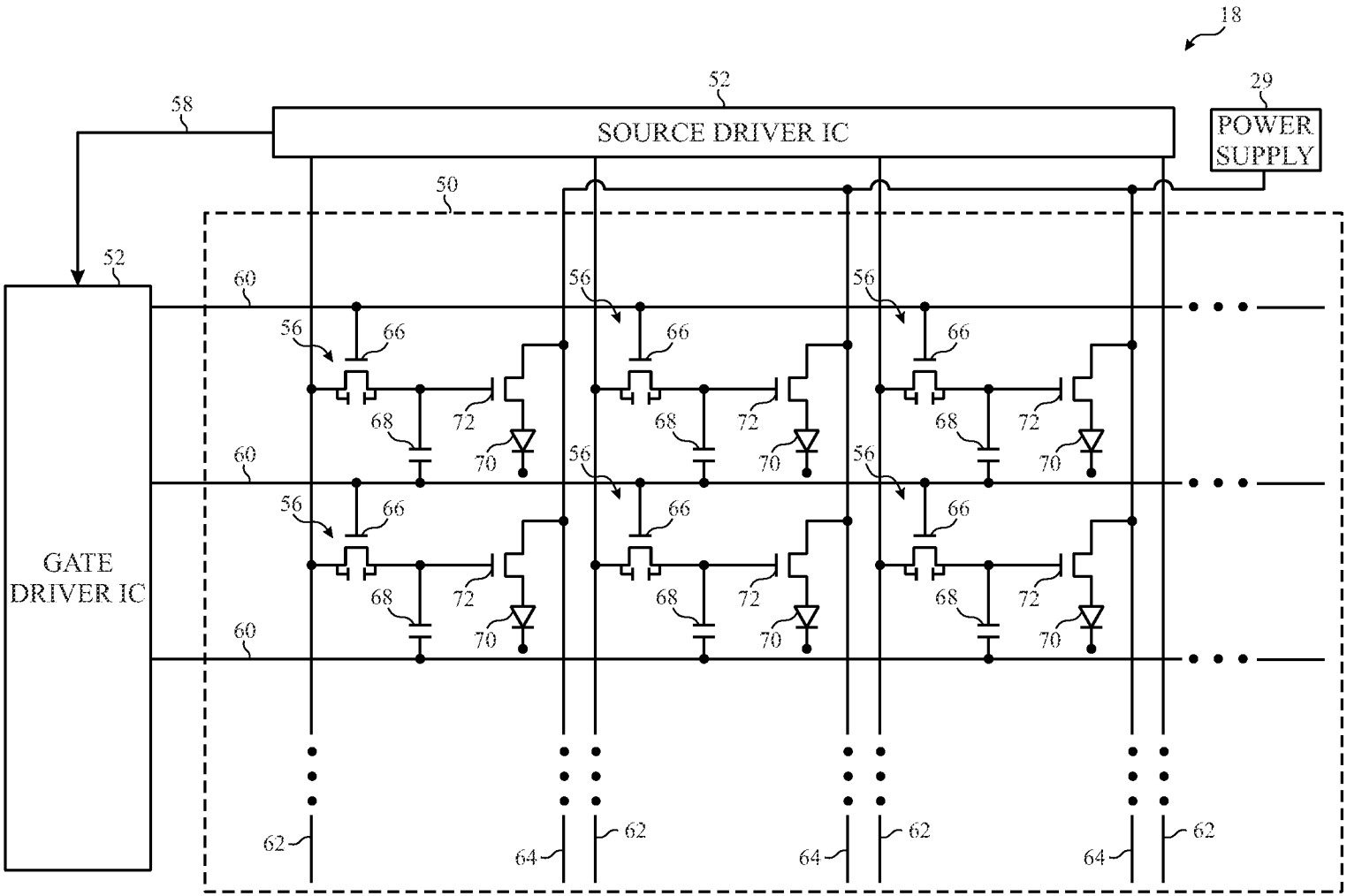
FIG. 7 illustrates a schematic diagram of an organic light emitting diode (OLED) electronic display in accordance with at least one embodiment.

To help illustrate, one embodiment of an OLED display 18 is described in FIG. 7. As depicted, the OLED display 18 includes a display panel 50, a source driver 52, a gate driver 54, and a power supply 29. Additionally, the display panel 50 may include multiple display pixels 56 arranged as an array or matrix defining multiple rows and columns. For example, the depicted embodiment includes a six display pixels 56. It should be appreciated that although only six display pixels 56 are depicted, in an actual implementation the display panel 50 may include hundreds or even thousands of display pixels 56.

As described above, an electronic display 18 may display image frames by controlling luminance of its display pixels 56 based at least in part on received image data. To facilitate displaying an image frame, a timing controller may determine and transmit timing data on line 58 to the gate driver 54 based at least in part on the image data. For example, in the depicted embodiment, the timing controller may be included in the source driver 52. Accordingly, in such embodiments, the source driver 52 may receive image data that indicates desired luminance of one or more display pixels 56 for displaying the image frame, analyze the image data to determine the timing data based at least in part on what display pixels 56 the image data corresponds to, and transmit the timing data to the gate driver 54. Based at least in part on the timing data, the gate driver 54 may then transmit gate activation signals to activate a row of display pixels 56 via gate lines 60.

When activated, luminance of a display pixel 56 may be adjusted by amplified image data received via data lines 62. In some embodiments, the source driver 52 may generate the amplified image data by receiving the image data and amplifying voltage of the image data. The source driver 52 may then supply the amplified image data to the activated pixels. Thus, as depicted, each display pixel 56 may be located at an intersection of a gate line 60 (e.g., scan line) and a data line 62 (e.g., source line). Based on received amplified image data, the display pixel 56 may adjust its luminance using electrical power supplied from the power supply 29 via power supply lines 64.

As depicted, each display pixel 56 includes a circuit switching thin-film transistor (TFT) 66, a storage capacitor 68, an OLED 70, and a driving TFT 72. To facilitate adjusting luminance, the driving TFT 72 and the circuit switching TFT 66 may each serve as a switching device that is controllably turned on and off by voltage applied to its gate. In the depicted embodiment, the gate of the circuit switching TFT 66 is electrically coupled to a gate line 60. Accordingly, when a gate activation signal received from its gate line 60 is above its threshold voltage, the circuit switching TFT 66 may turn on, thereby activating the display pixel 56 and charging the storage capacitor 68 with amplified image data received at its data line 62.

Additionally, in the depicted embodiment, the gate of the driving TFT 72 is electrically coupled to the storage capacitor 68. As such, voltage of the storage capacitor 68 may control operation of the driving TFT 72. More specifically, in some embodiments, the driving TFT 72 may be operated in an active region to control magnitude of supply current flowing from the power supply line 64 through the OLED 70. In other words, as gate voltage (e.g., storage capacitor 68 voltage) increases above its threshold voltage, the driving TFT 72 may increase the amount of its channel available to conduct electrical power, thereby increasing supply current flowing to the OLED 70. On the other hand, as the gate voltage decreases while still being above its threshold voltage, the driving TFT 72 may decrease amount of its channel available to conduct electrical power, thereby decreasing supply current flowing to the OLED 70. In this manner, the OLED display 18 may control luminance of the display pixel 56. The OLED display 18 may similarly control luminance of other display pixels 56 to display an image frame.

As described above, image data may include a voltage indicating desired luminance of one or more display pixels 56. Accordingly, operation of the one or more display pixels 56 to control luminance should be based at least in part on the image data. In the OLED display 18, a driving TFT 72 may facilitate controlling luminance of a display pixel 56 by controlling magnitude of supply current flowing into its OLED 70. Additionally, the magnitude of supply current flowing into the OLED 70 may be controlled based at least in part on voltage supplied by a data line 60, which is used to charge the storage capacitor 68. However, since image data may be received from an image source, magnitude of the image data may be relatively small. Accordingly, to facilitate controlling magnitude of supply current, the source driver 52 may include one or more amplifiers (e.g., buffers) that amplify the image data to generate amplified image data with a voltage sufficient to control operation of the driving TFTs 72 in their active regions.

Figure 8:
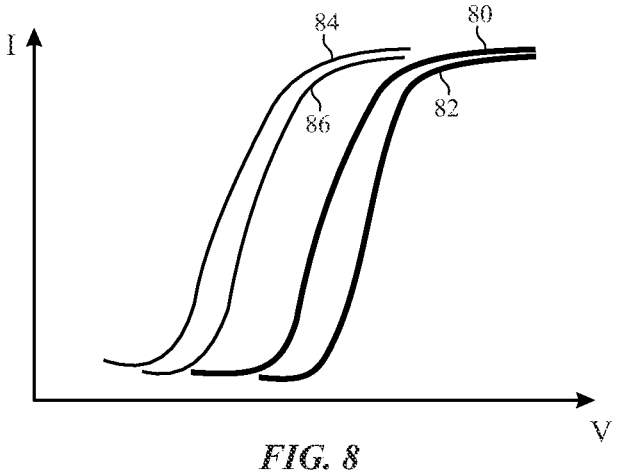
FIG. 8 is a graph illustrating transfer characteristics of TFTs demonstrating hysteresis at two different temperatures.

As mentioned above, the TFTs 72 typically exhibit hysteresis behavior that can affect the supply current to the OLEDs 70 and, thus, affect the luminance of the OLEDs 70. An example of such hysteresis behavior is illustrated in FIG. 8. The first set of curves 80 and 82 represent a transfer characteristic of a TFT 72 at a first temperature, such as room temperature. As can be seen, the threshold voltage of the TFT 72 in the forward voltage sweep direction illustrated by the curve 80 is lower than the threshold voltage of the TFT 72 in the reverse voltage sweep direction illustrated by the curve 82. As a result, at a given temperature, the threshold voltage and the current through the TFT 72 can differ depending upon the direction of the voltage sweep across the TFT 72. Furthermore, the second set of curves 84 and 86 illustrate the transfer characteristic of the TFT 72 at a second temperature higher than the first temperature. As can be seen, the threshold voltage of the TFT 72 in the forward voltage sweep direction illustrated by the curve 84 is lower than the threshold voltage of the TFT 72 in the reverse voltage sweep direction illustrated by the curve 86. Further, the threshold voltage of the TFT 72 in either voltage sweep direction at the higher temperature is lower than the threshold voltage of the TFT 72 at the lower temperature. Hence, the temperature of the TFT 72 can also affect the threshold voltage and, thus, the supply current through the TFT 72. As a result, both the hysteresis behavior of the TFT 72 and its operating temperature can affect the luminance produced by the OLEDs 70.

Figure 9:
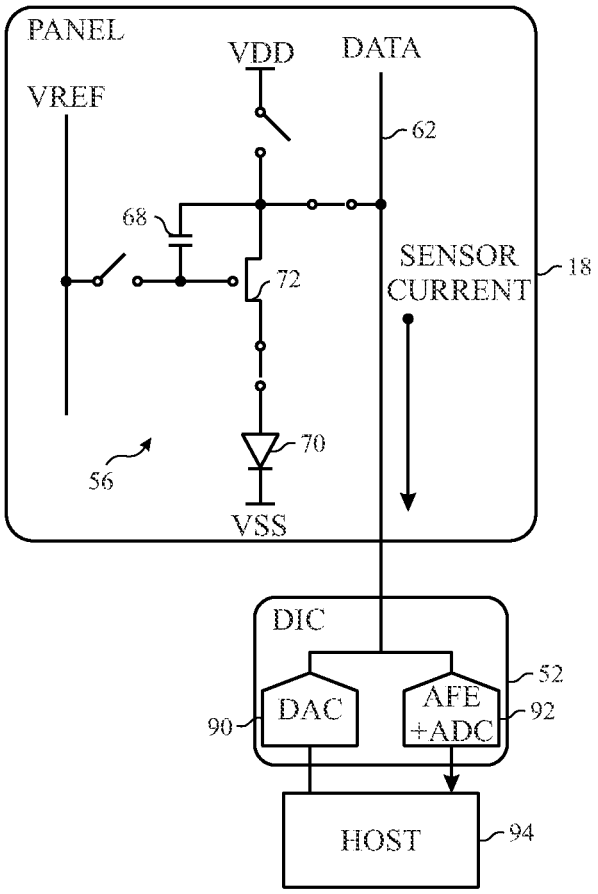
FIG. 9 illustrates a schematic diagram of an example of a pixel circuit in sensing mode in accordance with at least one embodiment.
Figure 10:
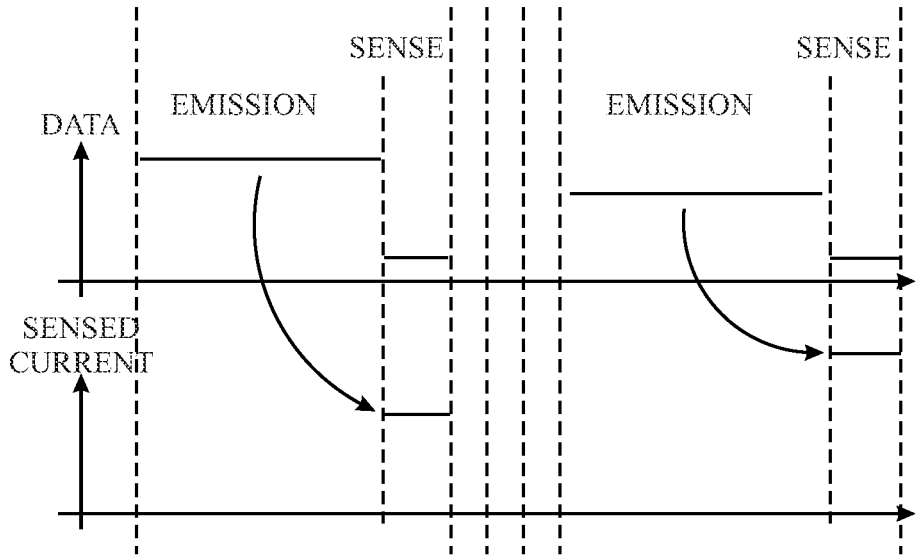
FIG. 10 illustrates an example of hysteresis effects of image data relative sensed current.
Figure 11:
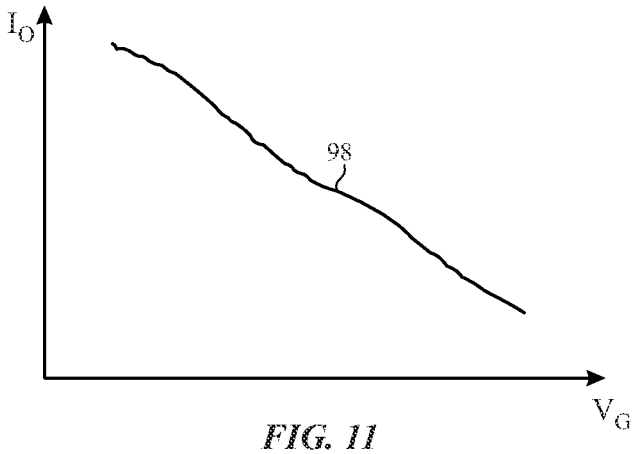
FIG. 11 is a graph illustrating the effect of gate voltage of a previous frame relative to sensed current.

The threshold voltage of the TFTs 72 may be sensed to determine any variation in threshold voltage, due to hysteresis, temperature, aging, etc. For example, FIG. 9 illustrates a display pixel 56 on a portion of the display panel 50 in sensing mode. In the sensing mode, the sensor current from the TFT 72 is delivered to the source driver IC 52 via the data line 62. The source driver IC 52 includes a digital-to-analog converter 90 and an analog front end and analog to digital converter 92 that facilitate communication between the source driver IC 52 and the host 94. As further illustrated in FIG. 10, it can be seen that the data delivered to the TFT 72 and the OLED 70 during an emission mode of the display pixel 56 and affect the level of current sensed during the sensing mode. Specifically, FIG. 10 illustrates that a high level of frame data in a previous frame results in lower sensed current because of different data history. Indeed, FIG. 11 illustrates this phenomenon in another manner. When a TFT 72 experiences different starting gate voltages $V_g$, it exhibits different output currents $I_o$ due to the hysteresis phenomenon and due to the different starting gate voltages $V_g$, as illustrated by the curve 98.

Figure 12:
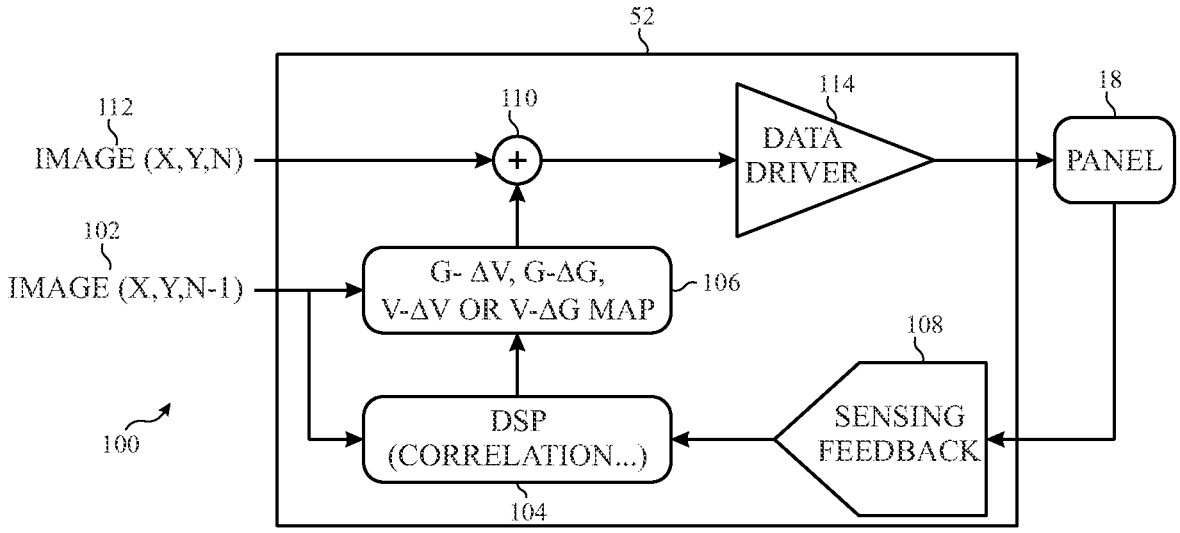
FIG. 12 illustrates a block diagram of an example of a hysteresis sensing and compensation circuit in accordance with the present techniques.

One example of a hysteresis sensing and compensation circuit 100 for addressing one or more of these issues is illustrated in FIG. 12. The circuit 100 may be embodied on the source driver IC 52 for instance. To compensate for hysteresis, temperature, aging, or other factors that may affect the luminance of the OLEDs 70 of the display 18, the circuit 100 receives image data from one or more previous image frames 102. This previous image frame data 102 is delivered to a digital signal processor (DSP) 104 and a map 106, which may be embodied in a lookup table (LUT) and/or correction algorithm, for example. The circuit 100 also includes a sensing feedback circuit 108 that may sense one or more parameters from the panel 50 and deliver the sensed parameters to the DSP 104 for a correlation with the previous image frame data 102. For example, such sensed feedback may include luminance levels of the OLEDs 70, supply current from the TFTs 72 to the respective OLEDs 70, threshold voltage levels of the TFTs 72, or any other measurable pixel properties. Further, the feedback may be in real time or it could be triggered by device usage, such as turning the display panel 50 on or off, periodic sampling, etc. This feedback may be delivered to the DSP 104 where it is correlated with the previous image frame data 102 and delivered to the map 106. The map 106 may include, for example, a map of gate voltage $V_G$ versus change in threshold voltage $V_{th}$ ($\Delta V_{th}$), $V_G$ v. $\Delta V_G$, $V_{th}$ v. $\Delta V_{th}$, or $V_{th}$ v. $\Delta V_G$. Once the proper amount of compensation is selected from the map 106 based on the previous image frame data 102 and the information from the DSP 104, the compensation information is delivered to a summer 110 where it is combined with the current image frame data 112. The compensated current image frame data is delivered to a data driver 114 for delivery to the panel 50. Hence, the compensated current image frame data received by the panel 50 should reduce or eliminate the effects of hysteresis, threshold voltage, supply current, etc., that might affect the luminance of the OLEDs 70 in the panel 50 to provide for a more consistent and accurate image to be displayed by the panel 50.

Figure 13:
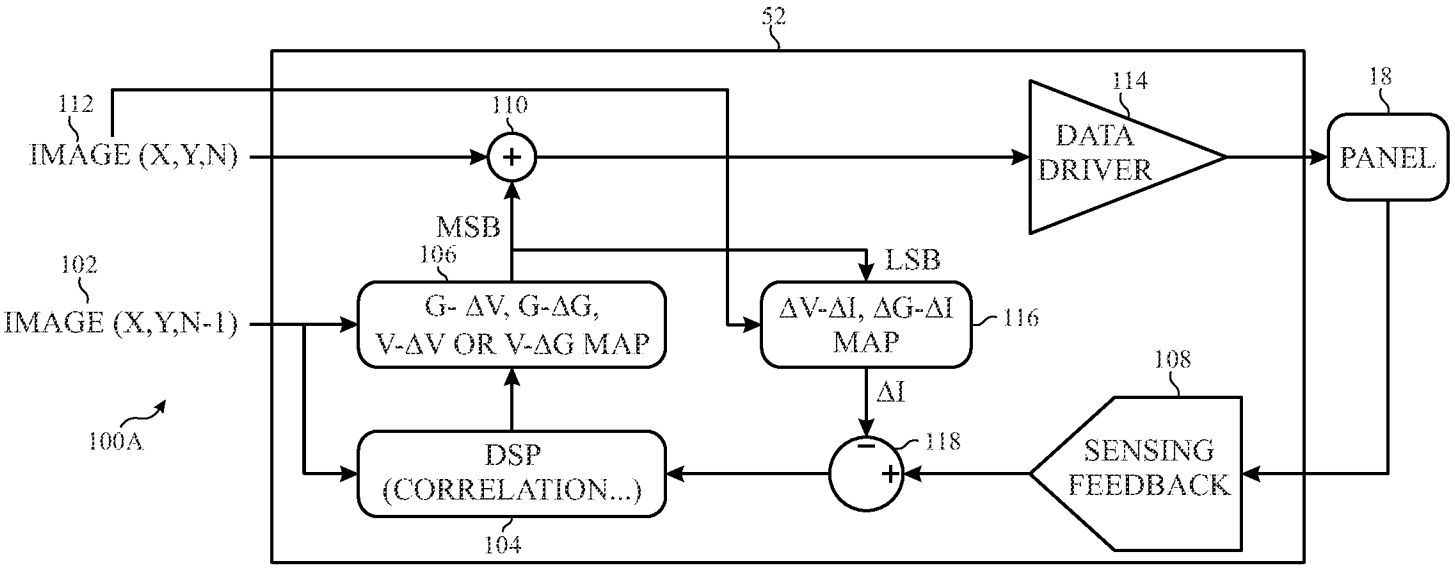
FIG. 13 illustrates a block diagram of another example of a hysteresis sensing and compensation circuit in accordance with the present techniques.

Another embodiment of a hysteresis sensing and compensation circuit 100A is illustrated in FIG. 13. The circuit 100A includes the items from the circuit 100, but adds an additional map 116 to provide "fine tuning" of the compensation signal delivered to the summer 110 to compensate the current image frame data 112. In this embodiment, the map 116 receives the current image frame data 112 along with the least significant bits (LSB) of the compensation information from the map 106. Here, the map 116 may include, for example, change in threshold voltage versus change in supply current ($\Delta V_{th}$ v. $\Delta I_o$) or change in gate voltage versus in change in supply current ($\Delta V_G$ v. $\Delta I_o$), and it may deliver change in supply current ($\Delta I_o$) data to a summer 118 so that such information may be subtracted from the sensing feedback prior to delivery to the DSP 104. As a result, the most significant bits (MSB) from the map 106 may be delivered to the summer 110 to compensate the current image frame data 112 prior to delivery to the data driver 114 and the panel 50.

Figure 14:
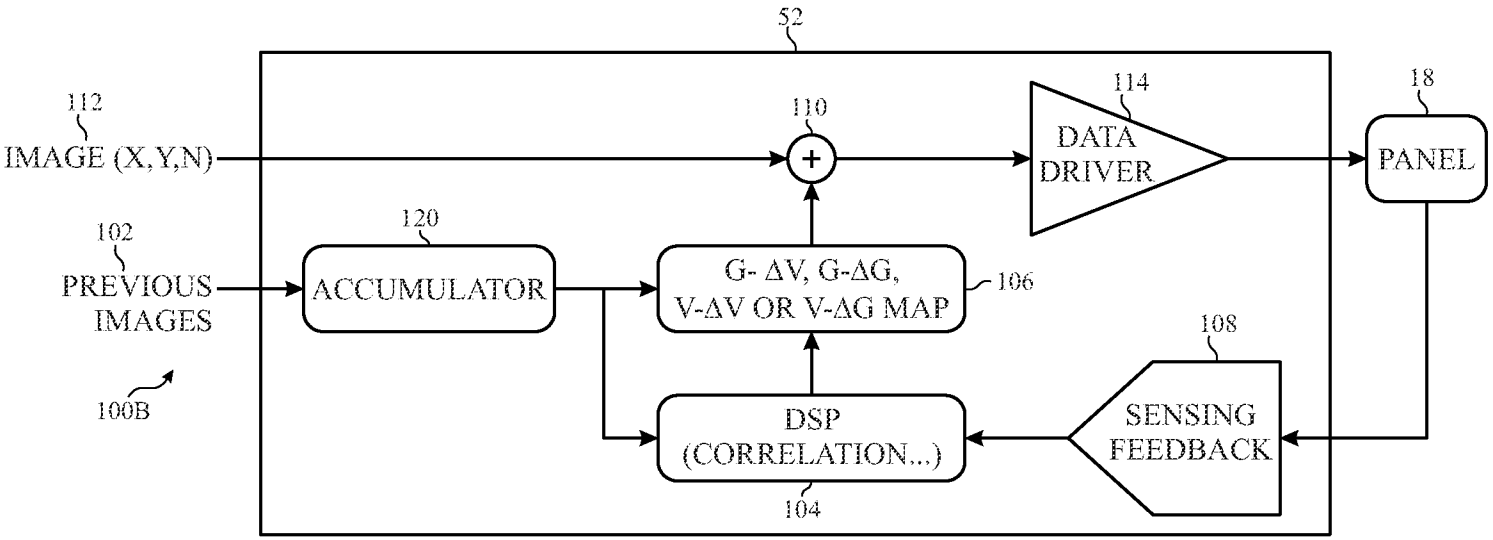
FIG. 14 illustrates a block diagram of yet another example of a hysteresis sensing and compensation circuit in accordance with the present techniques.

It has also been found that, at least under certain circumstances, not only can the immediately previous image frame data 102 adversely affect the display of the next frame of image data, but two or more previous frames of image data 102 can also affect the display of the current image frame. Accordingly, as illustrated in FIG. 14, an alternative embodiment of the hysteresis compensation and sensing circuit 100B is illustrated. Here, in addition to the items discussed above with respect to FIG. 12, the circuit 100B includes an accumulator 120 that accumulates data from two or more previous image frames. This accumulated previous image frame data is then delivered to the DSP 104 and the map 106 so that it may be taken into account prior to delivery of the compensation information to the summer 110. Specific example are described below with references to FIGS. 22 and 23.

Figure 15:
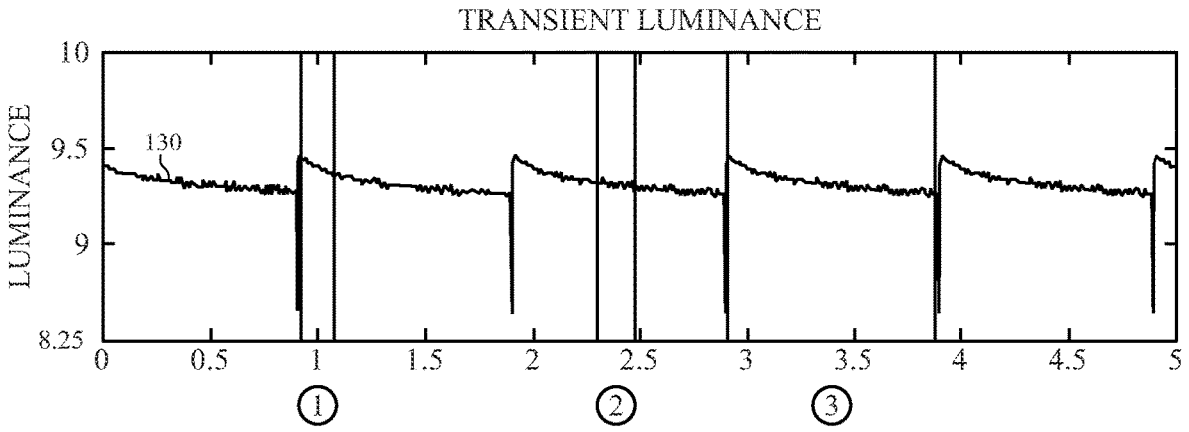
FIG. 15 is a graph illustrating pixel luminance over several frames with various sensing time options.
Figure 16:
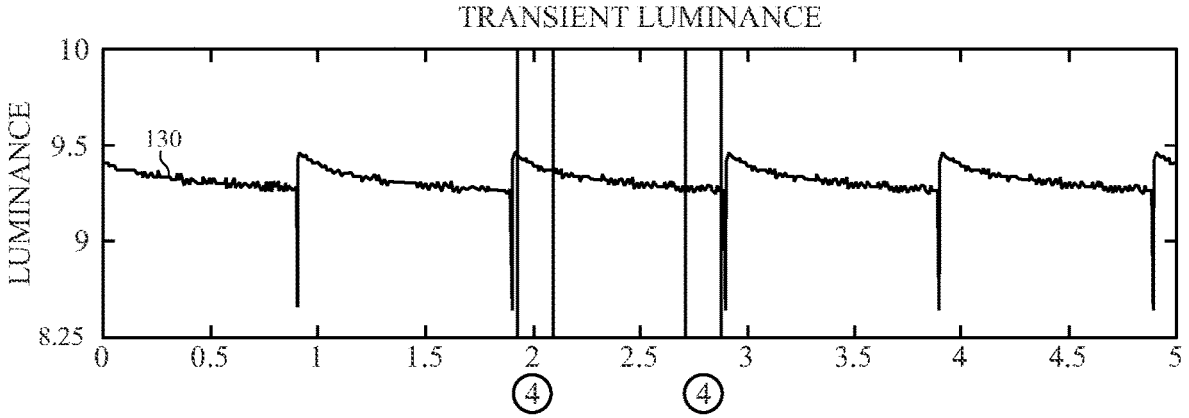
FIG. 16 is a graph illustrating pixel luminance over several frames with an example of multiple senses per frame.

It should also be noted that because the luminance of the OLEDs 70 can vary from the beginning of the frame to the end of the frame, the time during which the sensing feedback circuit 108 senses parameters, such as luminance, from the panel 50 may affect the overall manner in which the hysteresis sensing and compensation circuits 100 operate. For example, as illustrated in FIGS. 15 and 16, the luminance of an OLED 70 may be slightly higher at the beginning of a frame, as the data essentially decays until the beginning of the next frame, as illustrated by the luminance curves 130 during a sample five frame period. Hence, the sensor feedback circuit 108 may sense at the beginning of a frame to obtain the transient peak, may sense during the middle of a frame for optimization, or may sense throughout the entire frame to obtain the average luminance. Alternatively, as illustrated in FIG. 16, the sensing feedback circuit 108 may sense multiple times during a frame to capture a time constant of the decay, for example.

Figure 17:
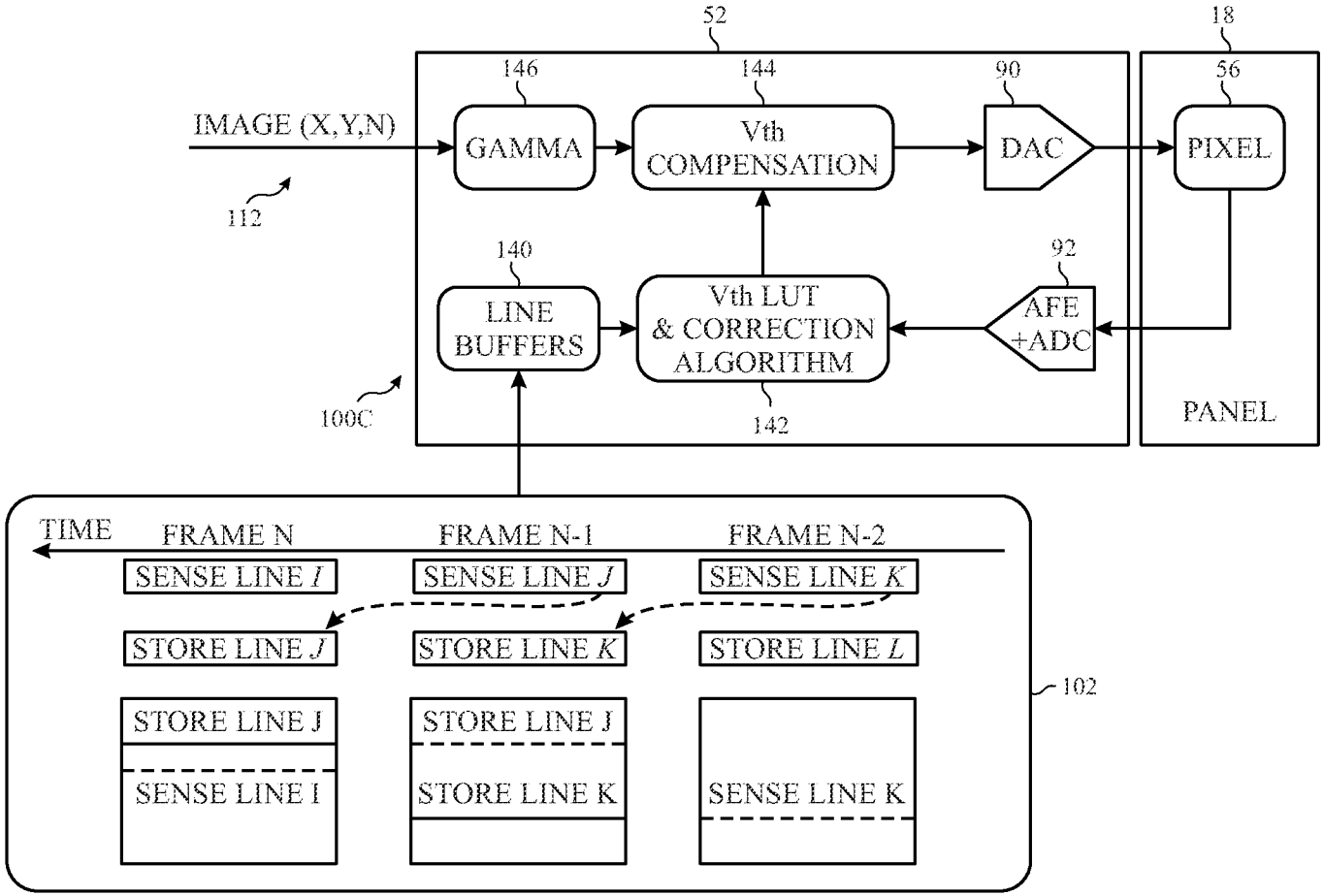
FIG. 17 illustrates a block diagram of a sensing scheme with hysteresis correction using one or more line buffers to store content of one or more previous frames for the correction of content history dependent threshold voltage hysteresis in accordance with the present techniques.

A more specific implementation of a hysteresis sensing and correction circuit 100C is illustrated in FIG. 17. In this embodiment, one or more line buffers 140 is used to store one or more frames of previous image frame data 102. As illustrated, for each sensed line of image data, the previously sensed line is stored instead via the one or more line buffers 140. One or more sensed parameters from the pixels 56 from the display panel 50 is delivered to a threshold voltage look-up table ($V_{th}$ LUT) and correction algorithm 142 via the AFE 90 and ADC 92. The $V_{th}$ LUT and correction algorithm 142 utilize the information from the previous frame or frames stored in the one or more line buffers 140 in conjunction with the sensed parameters to deliver compensation information to a threshold voltage $V_{th}$ compensation circuit 144. The current image frame data 112 is adjusted via a gamma circuit 146 and delivered to the $V_{th}$ compensation circuit 144, where the current image frame data 112 is further adjusted based on the compensation information from the $V_{th}$ LUT and correction algorithm 142. The compensated current image frame data is then delivered to the pixels 56 of the display panel 50 via a DAC 90.

Figure 18:
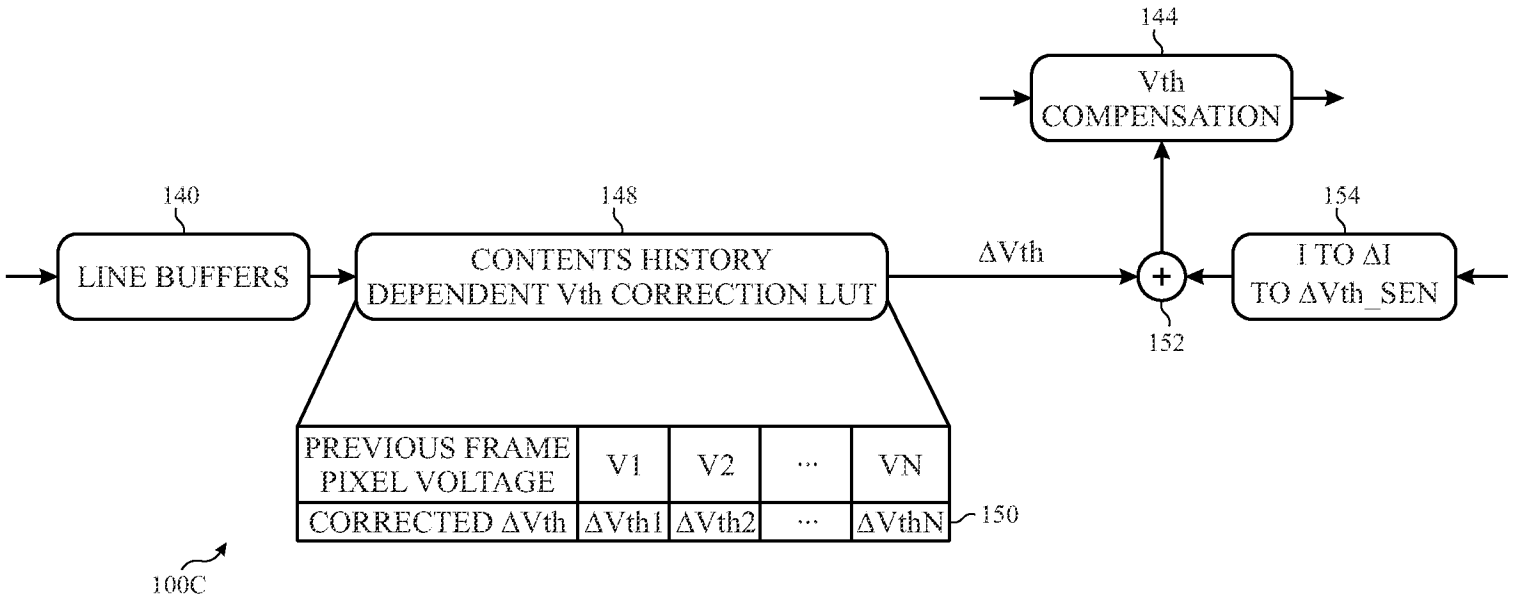
FIG. 18 illustrates a block diagram illustrating a portion of FIG. 17 in greater detail.
Figure 19:
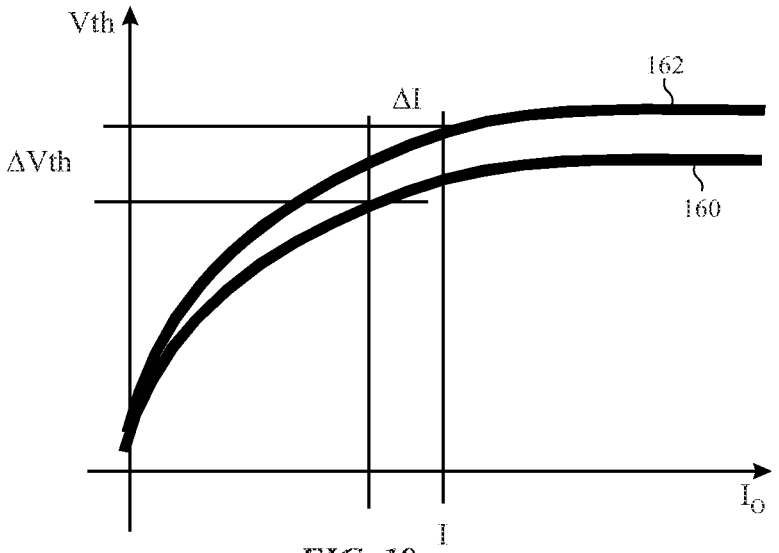
FIG. 19 is a graph illustrating change in threshold voltage versus change is sensed current.

A portion of the hysteresis sensing and correction circuit 100C is illustrated in greater detail in FIG. 18. Here, the lookup table (LUT) 148 of the $V_{th}$ LUT and correction algorithm 142 includes a table 150 that relates previous frame pixel voltage to corrected $\Delta V_{th}$. Hence, based upon the previous frame pixel voltage received from the one or more line buffers 140, the corrected $\Delta V_{th}$ is delivered to a summer 152 along with certain sensed parameters 154, such as $I_o$ v.$I_o$ relative to the $\Delta V_{th}$ sensed. The information from the summer 152 is delivered to the $V_{th}$ compensation circuit 144 for further processing as described above. Indeed, FIG. 19 illustrates a $\Delta V_{th}$ v. $\Delta I_o$ for two examples of curves 160 and 162 depicting $V_{th}$ v. $I_o$.

Figure 20:
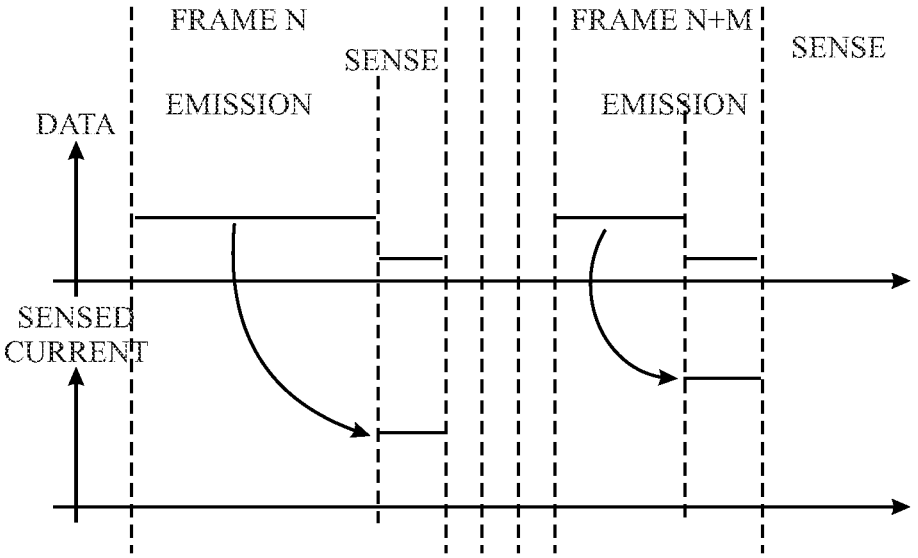
FIG. 20 illustrates an example of threshold hysteresis effects that may be dependent upon frame duration.
Figure 21:
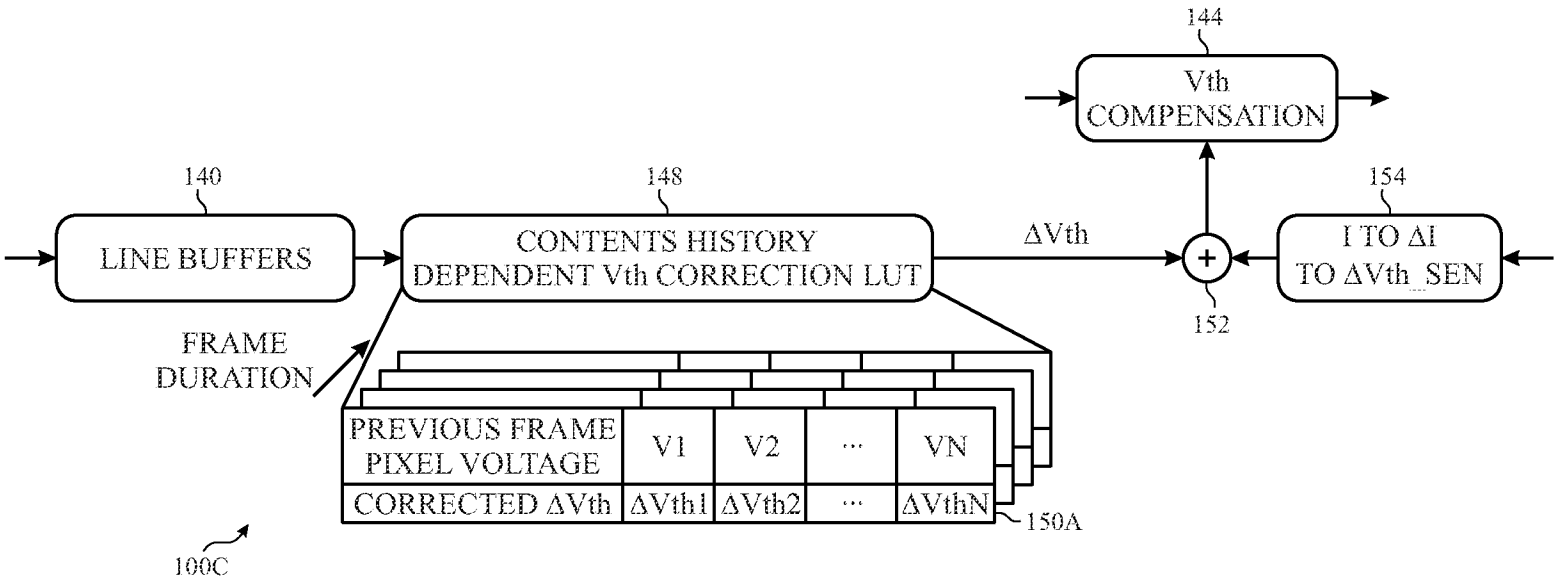
FIG. 21 illustrates a portion of FIG. 17 in greater detail where previous frame duration may be incorporated into the hysteresis correction scheme.

It should also be noted that, at least in some circumstances, the duration of the frame emission period may also affect the $V_{th}$ of the TFTs 72 as illustrated in FIG. 20. To address this concern, the hysteresis sensing and compensation circuit 100C illustrated in FIG. 21 includes information related to the duration or one or more previous frames to be used in the compensation of the current image frame data 112. As illustrated in FIG. 21, the LUT 148 includes tables 150A of frame pixel voltages versus corrected $\Delta V_{th}$ for various frame durations. Hence, this information may be processed as described with respect to FIGS. 17 and 18 above to compensate the current image frame data 112.

Figure 22:
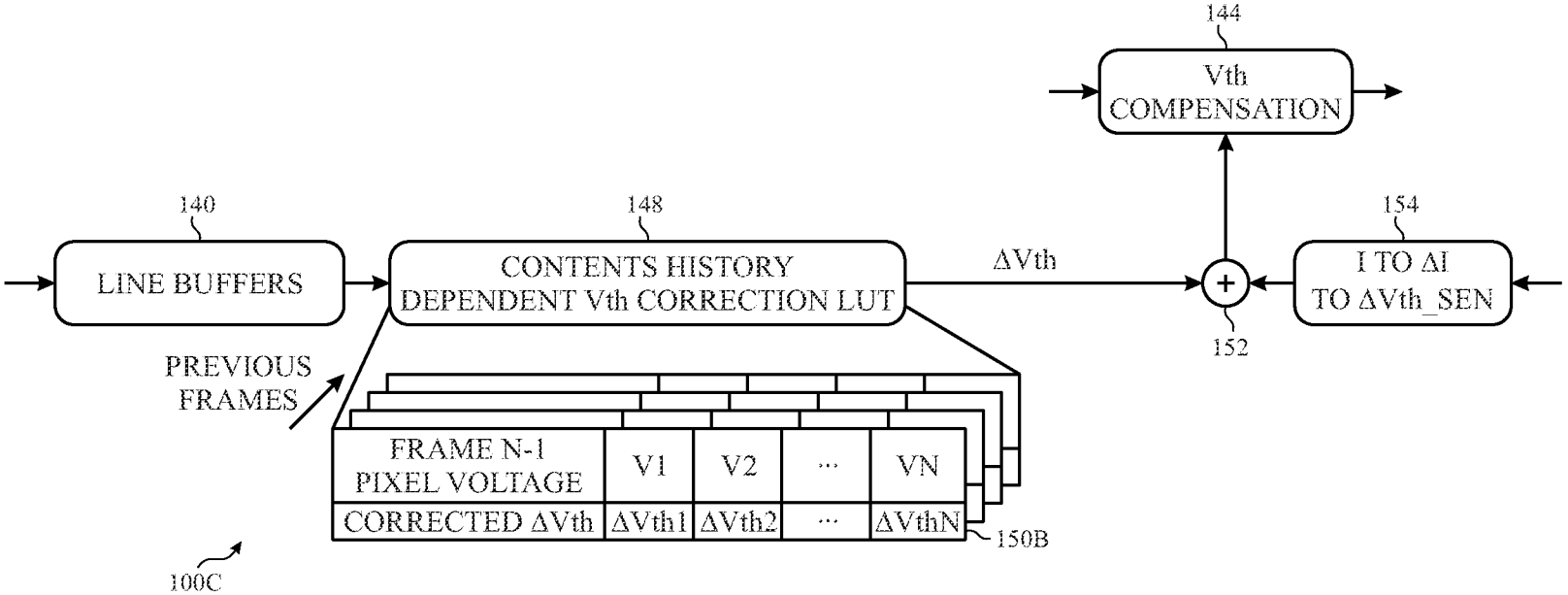
FIG. 22 illustrates a portion of FIG. 17 in greater detail where multiple line buffers are provided for the content of multiple previous frames.
Figure 23:
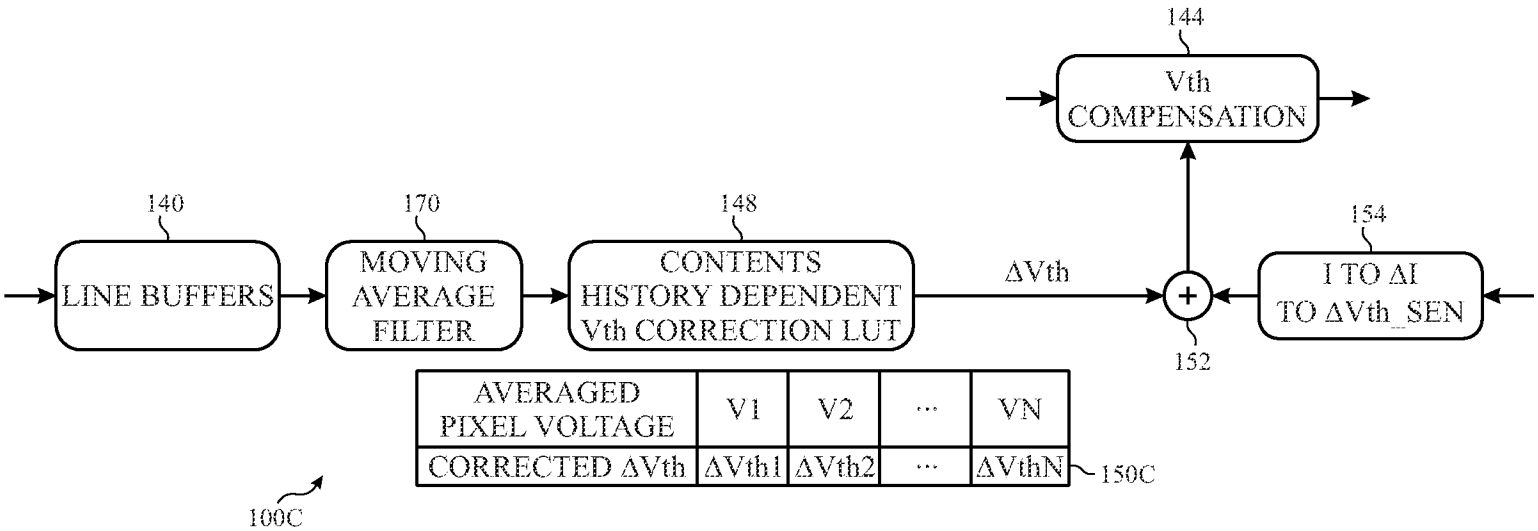
FIG. 23 illustrates a portion of FIG. 17 in greater detail where the hysteresis compensation scheme utilizes a moving average of the content of previous frames.

As previously mentioned, the $V_{th}$ of the TFTs 72 and, thus, the supply current ($I_o$) delivered to the OLEDs 70 may be affected not just by the immediately previous image frame data, but also by multiple frames of previous image frame data 102. Accordingly, the LUT 148 may include multiple tables 150B as illustrated in FIG. 22. Specifically, the tables 150B may include the pixel voltage from two or more previous frames relative to corrected $\Delta V_{th}$ which may be used to compensate the current image frame data 112 as described previously. Moreover, another way of taking into account multiple frame history is by use of a moving average filtering method. As illustrated in FIG. 23, the hysteresis sensing and compensation circuit 100C may include a moving average filter 170 that averages the contents of multiple previous frames that are stored in the line buffers 140. The LUT 148 may include one or more tables 150C that relate the average pixel voltage provided by the moving average filter 170 to an appropriate corrected $\Delta V_{th}$ which may be provided by the LUT 148 to the remaining portions of the circuit 100C to be processed as described above to compensate the current image frame data 112.

Figure 24:
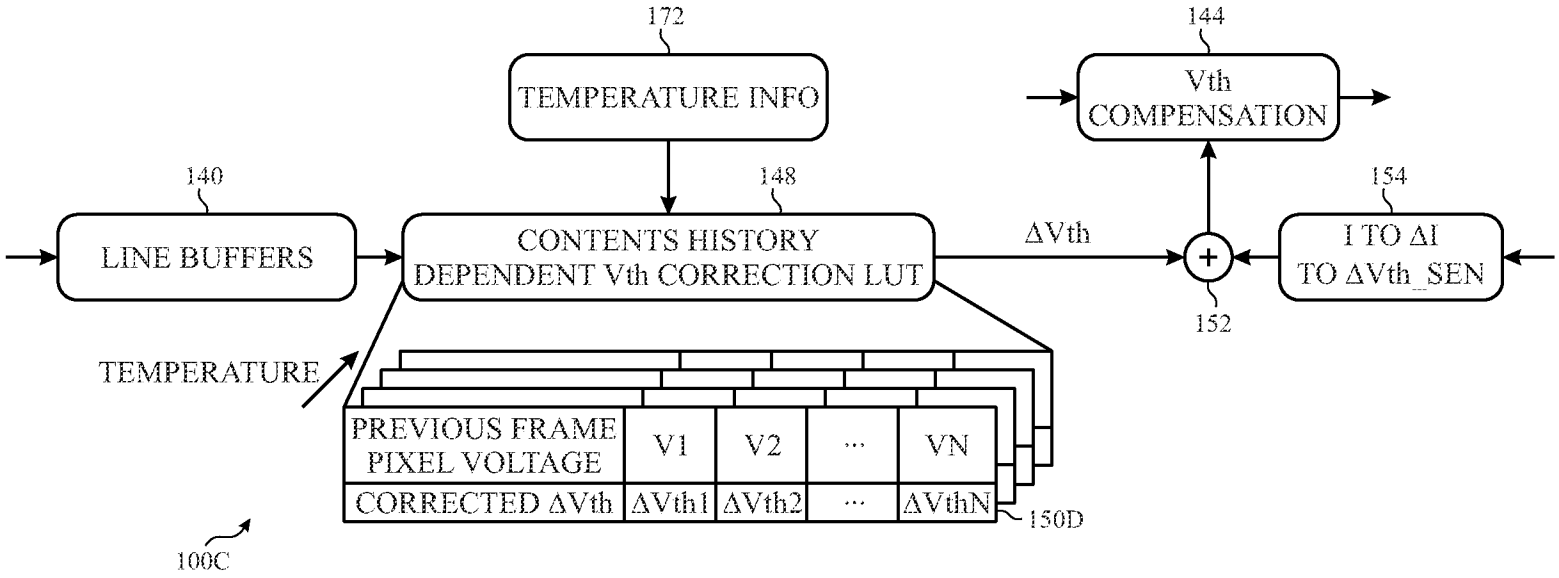
FIG. 24 illustrates a portion of FIG. 17 in greater detail where the compensation scheme uses temperature information.

As also mentioned previously, the temperature of the TFTs 72 can impact their hysteresis behavior. Accordingly, as illustrated in FIG. 24, the hysteresis sensing and compensation circuit 100C may obtain temperature information 172, using any appropriate temperature sensing device on the panel 50, for example. The LUT 148 may include one or more tables 150D that relate previous frame pixel voltage to corrected $\Delta V_{th}$ for various temperatures. The LUT 148 can thus select the most appropriate $\Delta V_{th}$ to be delivered for processing as described above to compensate the current image frame data 112.

It should be appreciated that while many of the techniques have been described separately above to ensure clarity, many of these techniques can be combined and used with one another to provide the most appropriate compensation information to be used to correct or compensate current image frame data 112 for any of these parameters that may affect the $V_{th}$ of the TFTs 72 and or the $I_o$ of the OLEDs 70.

The specific embodiments described above have been shown by way of example, and it should be understood that these embodiments may be susceptible to various modifications and alternative forms. It should be further understood that the claims are not intended to be limited to the particular forms disclosed, but rather to cover all modifications, equivalents, and alternatives falling within the spirit and scope of this disclosure.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

What is claimed is:

1. An apparatus for operating an electronic display, the apparatus comprising:

an input configured to receive data relating to a current image frame for the electronic display;

a storage device configured to store data relating to at least one previous image frame for the electronic display;

a sensing circuit configured to sense a parameter related to hysteresis of transistors of the electronic display;

a correlation device configured to receive the sensed parameter and the data relating to the at least one previous image frame and to output a compensation signal;

a summation node configured to receive the data relating to the current image frame and the compensation signal and to output a compensated current image frame; and a data driver configured to receive the compensated current image frame and to deliver the compensated current image frame to the electronic display.

2. The apparatus as set forth in claim 1, wherein the storage device comprises at least one line buffer.

3. The apparatus as set forth in claim 1, wherein the sensing circuit is configured to sense a supply current delivered from the respective transistors to their respective organic light emitting diodes.

4. The apparatus as set forth in claim 1, wherein the sensing circuit is configured to sense a temperature of the electronic display.

5. The apparatus as set forth in claim 1, wherein the sensing circuit is configured to sense a threshold voltage of the respective transistors.

6. The apparatus as set forth in claim 1, wherein the correlation device comprises a look up table that correlates data from the at least one previous image frame to a change in threshold voltage for each of the respective transistors.

7. The apparatus as set forth in claim 6, wherein the data from the at least one previous image frame comprises previous frame pixel voltages and wherein the change in threshold voltage comprises a corrected change in threshold voltage.

8. The apparatus as set forth in claim 1, wherein the correlation device comprises a look up table that correlates data from a plurality of previous image frames to a change in threshold voltage for each of the respective transistors.

9. The apparatus as set forth in claim 8, wherein the data from the plurality of previous image frames comprises respective pixel voltages of the plurality of previous image frames and wherein the change in threshold voltage comprises a corrected change in threshold voltage.

10. The apparatus as set forth in claim 8, wherein the data from the plurality of previous image frames comprises a moving average of respective pixel voltages of the plurality of previous image frames and wherein the change in threshold voltage comprises a corrected threshold voltage.

11. The apparatus as set forth in claim 1, wherein the correlation device comprises a look up table that correlates data from the at least one previous image frame to a change in threshold voltage for each of the respective transistors for a plurality of temperatures.

12. The apparatus as set forth in claim 11, wherein the data from the at least one previous image frame comprises previous frame pixel voltages and wherein the change in threshold voltage comprises a corrected change in threshold voltage.

13. A method, comprising:

receiving data relating to a current image frame for an electronic display;

receiving data relating to at least one previous image frame for the electronic display;

sensing a parameter related to hysteresis of transistors of the electronic display;

generating a compensation signal based on the sensed parameter and the data relating to the at least one previous image frame;

generating a compensated current image frame based on the data relating to the current image frame and the compensation signal; and delivering the compensated current image frame to the electronic display.

14. The method as set forth in claim 13, comprising averaging data from a plurality of previous image frames.

15. The method as set forth in claim 13, comprising sensing the parameter a plurality of times during the at least one previous image frame.

16. The method as set forth in claim 13, comprising sensing the parameter during a duration of the at least one previous image frame.

17. The method as set forth in claim 16, wherein the duration comprises an entire duration of the at least one previous image frame.

18. An electronic display, comprising:

an input configured to receive data relating to a current image frame for the electronic display;

a storage device configured to store data relating to at least one previous image frame for the electronic display;

a sensing circuit configured to sense a parameter related to hysteresis of transistors of the electronic display;

a digital signal processor configured to receive the sensed parameter and the data relating to the at least one previous image frame and to output a compensation signal;

a summation node configured to receive the data relating to the current image frame and the compensation signal and to output a compensated current image frame; and a data driver configured to receive the compensated current image frame and to deliver the compensated current image frame to the electronic display.

19. The electronic display as set forth in claim 18, wherein the sensing circuit is configured to sense the parameter at a middle of the at least one previous image frame.

20. The electronic display as set forth in claim 18, wherein the sensing circuit is configured to sense the parameter at a beginning of the at least one previous image frame.

21. The electronic display as set forth in claim 18, wherein the sensing circuit is configured to sense a luminance of the electronic display.

* * * * *